United States Patent [19]

Suzuki et al.

[11] 4,261,191

[45] Apr. 14, 1981

[54] METHOD AND APPARATUS FOR WINDING METAL WIRES AROUND A REEL STRUCTURE

[75] Inventors: Haruo Suzuki; Makoto Ida, both of Fukuchiyama; Atutosi Takaki, Ibaragi; Yasuo Araike; Yosikazu Sasa, both of Fukuchiyama; Kazuhide Yoshida, Kyoto, all of Japan

[73] Assignee: Kobe Steel, Limited, Kobe, Japan

[21] Appl. No.: 33,250

[22] Filed: Apr. 25, 1979

[30] Foreign Application Priority Data

Apr. 28, 1978 [JP] Japan ..... 53-51919

[51] Int. Cl.[3] ..... B21F 3/10

[52] U.S. Cl. ..... 72/138; 72/143; 242/159; 242/176

[58] Field of Search ..... 72/138, 137, 148, 142, 72/143; 292/159, 172, 174, 176

[56] References Cited

U.S. PATENT DOCUMENTS

| | | | |
|---|---|---|---|
| 1,083,501 | 1/1914 | Lewis | 72/138 |
| 1,258,092 | 3/1918 | Clark | 72/137 |
| 2,265,246 | 12/1941 | Ott | 242/174 X |
| 2,739,763 | 3/1956 | Silfverling et al. | 72/138 |
| 3,145,760 | 8/1964 | Brautigam | 72/138 |
| 3,420,080 | 1/1969 | Supina et al. | 72/138 |
| 3,581,389 | 6/1971 | Mori | 29/598 |
| 3,587,274 | 6/1971 | Rotter | 72/148 |
| 3,994,058 | 11/1976 | Sasaki et al. | 29/428 |
| 4,019,359 | 4/1977 | Smith | 72/231 |
| 4,019,543 | 4/1977 | Sasaki et al. | 140/111 |

*Primary Examiner*—Carl E. Hall

*Attorney, Agent, or Firm*—Oblon, Fisher, Spivak, McClelland & Maier

[57] ABSTRACT

A method of winding a metal wire around a reel structure is disclosed in which the wire is wound about a roller to give the wire a round habit of preselected diameter, at least one of the last few coils of said wire being strained so as to increase the diameter of the round habit, and all of the wire being wound on a reel structure whereby the at least one coil having the larger diameter round habit is coiled about the reel structure in an expanded condition with respect to the remainder of the coils. An apparatus for performing this method is also disclosed.

5 Claims, 8 Drawing Figures

METHOD AND APPARATUS FOR WINDING METAL WIRES AROUND A REEL STRUCTURE

BACKGROUND OF THE INVENTION

1. Field of the Invention

The present invention relates to a method and an apparatus for winding metal wires on a coiling structure (which is hereinafter referred to as "a spool"), and more particularly to a metal winding method and apparatus whereby, if the end portion of the metal wire wound on the spool springs back, the last group of coils near the wire end are prevented from becoming entangled with each other so as to facilitate drawing-out of the wire.

2. Description of the Prior Art

In the following description, the term "coil radius" signifies the expansion in a radial direction of the coil or the radius of the coil when the restraining force is released from the wire, and the word "coil pitch" means the distance between adjacent coils of the wire in the direction of the pitch when the coils are released from the restraining force.

Every type of metal wire wound on the spool is strained to have a certain radius. In the case of welding wire on the market, the wire is strained to have a certain coil radius and wound on the spool with its end fixed to the spool flange. This is accomplished to control the degree of the spring back action of the wire and to stabilize the feeding of the wire into a curved conduit tube. When this wire is to be unwound and used, the wire end is taken off the spool flange or is released from restraint by cutting the wire at the flange and then the wire end is conducted into a draw-out device. During this process, however, the smooth drawing-out of the wire is often blocked due to the spring-back action of the wire itself.

Wire materials such as welding wires are strained during the winding process to obtain a certain coil radius, but at the same time the coil pitch is adjusted to almost zero to ensure smooth feeding of the wire, for example, into the conduit tube. As long as the wire end is secured to the spool flange, the wire does not become loose. But if the wire end slips from a grip when it is being released from the flange, about 10 coils near the wire end spring back due to their own elastic force, with the result that they become entangled. This tendency is prominent in a reeled wire that has a smaller coil pitch. In the welding wire whose coil pitch is almost zero, several coils at the end of the wire gather and become entwined in one knot. This makes it difficult to draw out the wire end and if the wire end is drawn out with the coils entangled, the coils are squeezed so that the resistance against the drawing out of wire increases, thus causing the wire feeding to become unstable or in the worst case blocking the feeding. In the course of novelty search, the following U.S. Patents were located.

U.S. Pat. No. 4,019,359 to Smith, 3,587,274 to Rotter, 3,581,389 to Mori, 2,997,076 to McVoy, Jr., 2,739,763 to Silfverling et al, 2,265,246 to Ott and 1,258,092 to Clark.

U.S. Pat. No. 2,739,763 to Silfverlin et al discloses an apparatus for coiling cold rolled strips in which it is desired that the final turns of the strip be bent to such a curvature that the coil does not unwind to any appreciable extent. The strip is bent by a plurality of bending rolls mounted upon movable arms. The cylinder may be actuated to move the roller closer to rollers near the end of the strip so that the last few turns of the strip will have a smaller diameter and the strip will coil tightly about the coiler. Silfverlin et al patent therefore discloses the general idea of providing the last few turns of a coil strip with a diameter, or round habit, from the remainder of the strip for a specific purpose. Furthermore, Silfverlin et al suggests, on lines 43–46 of the column 2, that the tensioning of the strip will not lessen the amount of prebending or circular habit which is imparted upon a metal strip. This is contrary to the teaching of the present invention which discloses that the tensioning, or straining, of the strip will decrease the amount of prebending, thereby providing a larger diameter round habit.

U.S. Pat. No. 2,265,246 to Ott discloses a metal coil and a method for forming the same in which the last turn of the strip is given a lesser diameter by being progressively curled on a curling dye as it is wound on a core. The lesser diameter end portion of the coil is then allowed to curl adjacent the remainder of the coil. Ott discloses that the purpose of curling the end portion of the strip is to prevent a straight strip end which would become entangled with the remainder of the coil or with other coils prior to unwinding.

U.S. Pat. No. 4,019,359 to Smith discloses a method and apparatus for hot rolling metal strip. In Smith, the metal strip is prebent or given a round habit by a set of three bending rollers prior to being wound upon a coil. Furthermore, Smith discloses, at lines 60 and 61 of column 4, that the required degree of curl, or the required round habit, decreases as the amount of strip is fed onto the coil. Smith therefore generally suggests progressively increasing the diameter of the round habit of the strip as one approaches the end of the strip. However, the suggestion in Smith is for a gradual, progressive increase in the diameter of the round habit of the strip along the entire length of the strip while, in the present invention, only the last turn or the last few turns are given the larger diameter round habit. Furthermore, the round habit in Smith is not provided by means which strain the last few turns but rather is provided by traditional bending rollers.

The remainder of the cited references generally show prebending or tensioning means for metal wires or strips which are to be coiled, however, they are not believed to be as pertinent as the above references.

SUMMARY OF THE INVENTION

The object of the present invention is to provide a method and an apparatus of winding metal wires around a reel structure which enables manufactured stocks of wound wires to easily utilized without the danger of entaglement. The above and the other objects can be achieved by the novel features of the invention which is hereinafter described with reference to the reference numerals of the attached drawings in the following detailed description.

BRIEF DESCRIPTION OF THE DRAWINGS

Various other objects, features and attendant advantages of the present invention will be more fully appreciated as the same becomes better understood by the following detailed description when considered in connection with the accompanying drawings in which like reference characters designate like or corresponding parts throughout the several views, and wherein.

DETAILED DESCRIPTION OF THE PREFERRED EMBODIMENTS

Welding electrode wires are wound on spools by, for example, the method which is shown in U.S. Pat. Nos. 3,994,058 and 4,019,543 to Kobe Steel Limited. Applicants have conducted various kinds of examinations to see if it is possible to keep the end of the wire from being entwined with other coils when the reeled wire on the spool springs back so that smooth feeding of wire is ensured. As a result, it has been found that this objective can readily be achieved by imparting strain to the end of the wire in the last process of winding, and this finding leads to the present invention.

Namely, the point of the wire winding method according to the present invention lies in the fact that, during the wire winding process, the last coil of wire (or the last group of coils) is strained in such a way that it tends to relax further away from the spool than a coil (or a group of coils wound immediately before the last coil (or the last group of coils).

The construction and effect of the present invention will now be described with reference to the accompanying drawings that show embodiments of this invention. It should be noted that the present invention is not to be restricted by the following description and can be embodied in other forms with modifications without departing from its spirit or essential characteristics.

Figure 1:
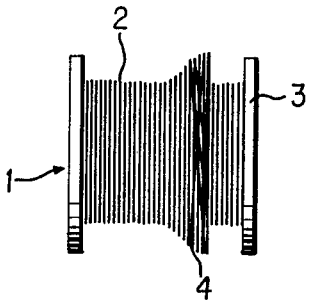
FIG. 1 PRIOR ART
FIG. 1 is an explanatory drawing showing the condition in which the wire wound up in the conventional method rests when it springs back.

FIG. 1 is an explanatory drawing showing the condition in which the welding wire 2 wound on the spool 1 in a conventional way rests when it springs back by releasing the wire end. When the wire 2 is wound in such a manner as to make the coil pitch as small as possible and its end is released from a flange 8 of the spool 1, about ten turns of winding spring back and become intertwined with each other forming a knot 4. This makes it difficult to draw out the end of the wire 2 and when the wire end is drawn out with coils entangled the aforementioned problem arises.

FIGS. 2 through 6 are explanatory drawings showing the wires 2 in the spring-back condition which have been strained in the winding process according to the invention. In either case, the end of the wire 2 is not intertwined with other windings so that it can readily be drawn out.

Figure 2:
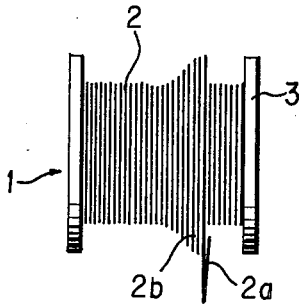
FIG. 2 is an explanatory drawing showing one aspect of the present invention.

Referring to FIG. 2, a last coil 2*a* at the end of the wire 2 (or several coils including the last one: the same shall apply hereinafter) is strained so that it tends to expand circumferentially and have a larger diameter than a coil 2*b* (or several coils including the coil 2*b*: the same shall apply hereinafter) would immediately before the last coil 2*a*. Thus, the last coil 2*a*, when released, springs back and rests further away from the spool 1 than the coil 2*b* of the wire so that entanglement of the last coil 2*a* with other coils can be prevented, ensuring smooth drawing out of wire.

Figure 3:
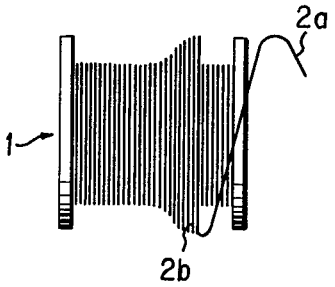
FIG. 3 is an explanatory drawing showing the condition in which the wire rolled up in a method according to the invention, rests when it springs back.

In FIG. 3, the last coil 2*a* at the wire end is strained in such a manner as to cause it to expand and rest in a position which is deviated away from the spool 1 in a direction of the coil pitch when it springs back.

Figure 4:
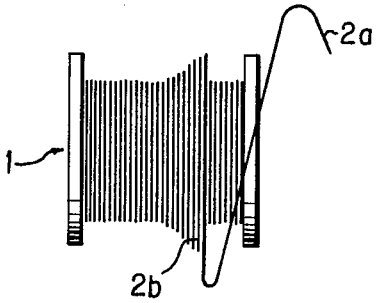
FIG. 4 is an explanatory drawing showing the condition in which the wire also rolled up in a method according to the invention, rests when it springs back.

In FIG. 4, the last coil 2*a* at the wire end is strained to a different degree in such a way as to cause it not only to expand circumferentially but to also project from the spool 1 in the direction of the coil pitch when it springs back.

As in the case with FIG. 2, the last coil 2*a* at the wire end in FIGS. 3 and 4 is prevented from becoming entangled with other coils, which enables smooth drawing-out of the wire.

Figure 5:
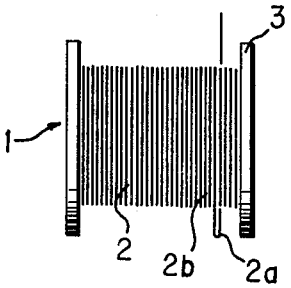
FIG. 5 is an explanatory drawing showing the condition in which the wire rolled up in another method according to the invention, rests when it springs back.

FIG. 5 shows another example in accordance with the present invention in which the last coil 2*a* at the wire end is rolled up with the same coil radius as other coils while the second last coil 2*b* is strained so that it tends to contract. In this case, since the coil 2*b* tends to contract, it squeezes the spool with its contractile force and prevents other coils from springing back. This means that only the last coil 2*a* springs back away from the spool 1 and thus can easily be picked up and drawn out.

Figure 6:
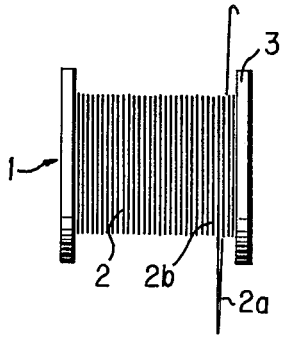
FIG. 6 is an explanatory drawing showing the condition in which the wire rolled up in still another method according to the invention, rests when it springs back.

FIG. 6 is a modification of the example shown in FIG. 5 in which the last coil 2*a* at the wire end is strained so that it coils radius tends to become larger, as in the case with FIGS. 2 and 4, and at the same time the second last coil 2*b* is strained so that its coil radius tends to become smaller.

While FIGS. 2 through 6 show examples where only the last one coil 2*a* at the end of the wire 2 is strained in such a way that it ends to expand away from the spool 1, the same effect can be obtained if the last two or three coils are strained in the same manner. In the examples of FIGS. 5 and 6 only the second last coil 2*b* is strained for squeezing the spool 1 but it is desirable to strain the last two or three coils in the same manner so as to make the spring-back preventing effect more reliable.

FIGS. 2 through 6 show only typical examples and any other form of strain can be applied to the coil (or group of coils), provided it projects further away from the spool than other remaining coils.

In the preceding examples, the spool is shown as having regularly wound coils for convenience sake but the same effect can be obtained if the wire is wound crosswise. The cross-winding is a modification of the regular winding. The entanglement among the last several turns of coil is caused when the spring back becomes prominent if the coils are irregularly wound. However, this invention also prevents the entanglement of irregularly wound coils and enables the wire to be easily drawn out.

The concrete method for straining the wire will now be described as follows.

Figure 7:
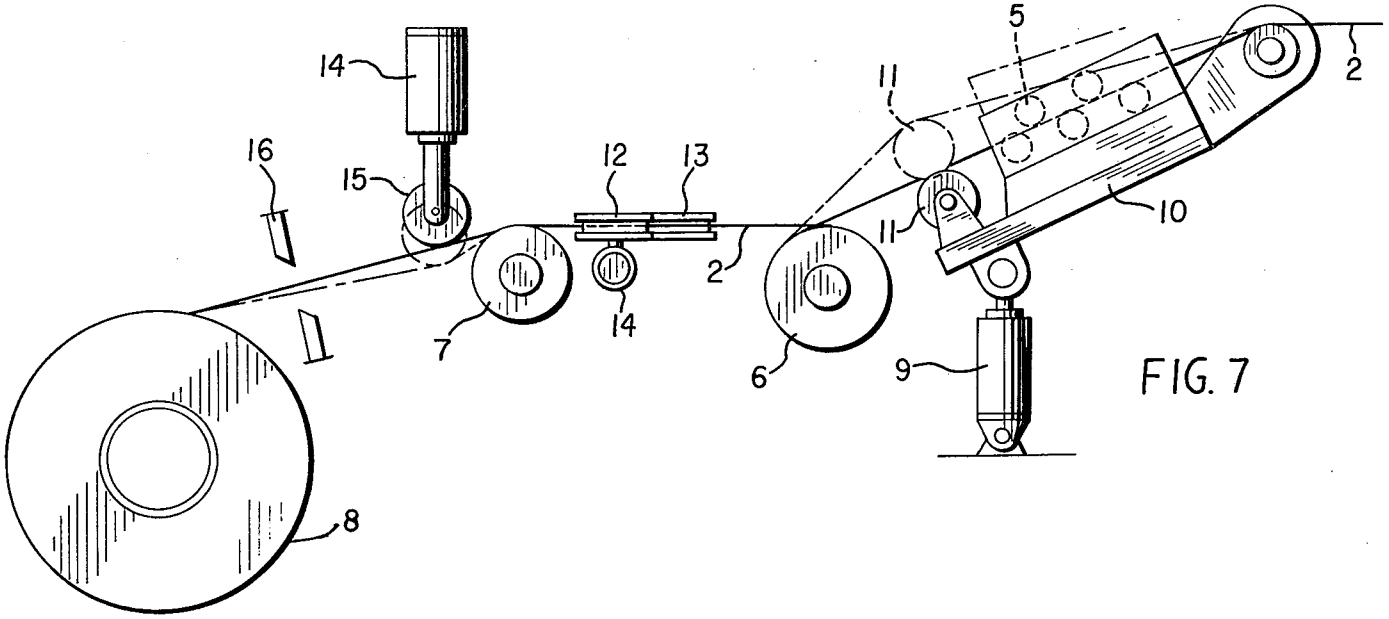
FIG. 7 is a side view showing an apparatus according to the invention, which includes various aspects of constructions.
Figure 8:
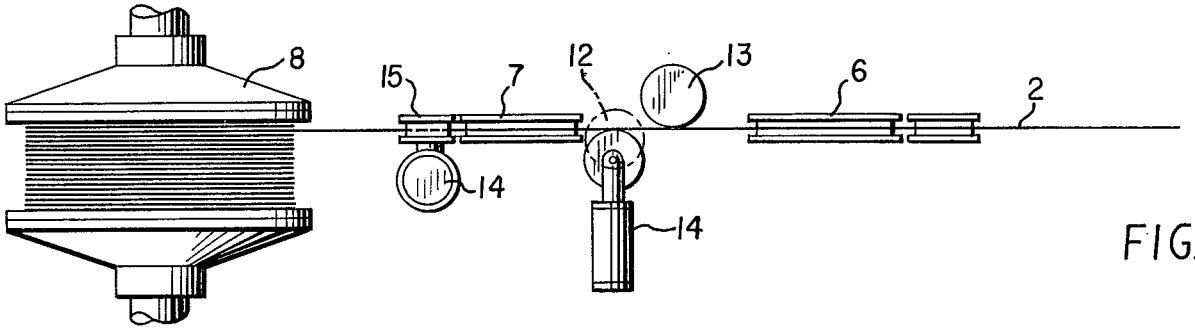
FIG. 8 is a plan view of the apparatus according to the invention as shown in FIG. 7.

FIGS. 7 and 8 are explanatory drawings showing an apparatus for straining the wire 2, FIG. 7 being a simplified side view and FIG. 8 being a simplified plan view.

Reference numeral 5 denotes rectifying rollers, reference numeral 6 designates a roller for straining the wire into coils of normal radius and reference numeral 7 denotes a fixed roller. The wire 2 is led through these rollers and is wound round a rotating spool 8 which is moved up and down during the winding process. The rectifying rollers 5 are mounted on a stand 10 which is pivoted by a cylinder 9 or other means and a coil radius adjusting roller 11 is provided to the pivotable stand 10 on the side of the roller 6. When the adjusting roller 11 is held in a position indicated with a solid line in FIG. 7, this roller 11 does not act upon the wire 2, but when the stand 10 is rotated by actuating the cylinder 9 and the roller 11 is moved forward to a position indicated with an imaginery line in FIG. 7, the wire 2 is strained by the roller 11 so that it tends to reduce its coil radius. Thus, the coil radius of the wire can be controlled by adjusting the position of the roller 11 (i.e., the degree of rotation of the stand 10).

Reference numeral 12 denotes a coil pitch adjusting roller and reference numeral 13 a fixed roller, both of such rollers cooperating for controlling the coil pitch of the wire. As can be seen from the FIG. 8, the coil pitch adjusting roller 12 is so arranged that it can be moved towards and away from the wire 2 by an actuating mechanism such as a cylinder 14'. When the adjusting roller 12 is in a position indicated with a solid line in FIG. 8, the roller 12 does not strain the wire 2. But when the adjusting roller 12 is moved forward to a position indicated with an imaginary line in FIG. 8, the wire 2 is strained in the direction of the coil pitch. Thus, the coil pitch can be controlled by adjusting the position of the roller 12.

Further, provided behind the fixed roller 7 is an adjusting roller 15 for enlarging the coil radius of the wire 2. The roller 15 is so arranged that it can be moved towards and away from the wire 2 by means of an actuating mechanism such as a second cylinder 14. When it is moved toward a position indicated with an imaginary line in FIG. 7, the wire 2 is pressed from the back so that its coil radius becomes larger. Designated by reference numeral 16 in FIG. 7 is a cutter.

The following are the wire winding steps used in this apparatus. Until the wire end approaches, the adjusting rollers 11, 12 and 15 are kept in the positions indicated with solid lines in FIGS. 7 and 8 while the wire 2 is rolled up with the normal coil radius. Just before the wire runs out, these adjusting rollers are moved toward the wire 2 to strain the wire near its end so that the desired coil radius and/or coil pitch can easily be obtained.

It should be noted that FIGS. 7 and 8 illustrate only one example of embodiments according to this invention and that modification can be made without departing from the scope of the invention. For instance, the location of the coil radius adjusting rollers 11 and 15 and the coil pitch adjusting roller 12 can be changed from that described in the drawing, and it is possible to employ as the actuating mechanism for these rollers a rotating arm, a pantograph, a link, and a solenoid mechanism in addition to the cylinder. With these modifications the same effect and result can be obtained.

This invention can not only be embodied in equipment specially designed for this purpose but can also be achieved by providing the coil radius adjusting rollers 11, 12 and 15 to the existing wire winding apparatus, thus reducing the corresponding economical burden.

The present invention which is in general constituted and embodied as explained in the foregoing descriptions is summarized as follows. When the wire rolled up around the spool springs back, only the wire end projects away from the spool, rendering the drawing-out of the wire very easy and at the same time eliminating any possibility of the wire being drawn out with coils entangled. Therefore, there are no such problems such as the wire feeding being obstructed by increased resistance. Because of these characteristics, the invention provides a practical and convenient method of winding various metal wires including wires for automatic or semiautomatic welding.

Obviously, numerous modifications and variations of the present invention are possible in light of the above teachings. It is therefore to be understood that within the scope of the appended claims, the invention may be practiced otherwise that as specifically described herein.

What is claimed as new and desired to be secured by letters patent of the United States is:

1. A method of winding a metal wire around a reel structure associated with at least one roller for assisting unwinding of wire from the reel comprising the steps of:

straining and winding said wire about said roller to give the wire a round habit of a preselected diameter;

selectively straining to a different degree only at least one of the last few coils of said wire so as to increase the diameter of the habit of said at least one of the last few coils; and winding all of said wire on said reel structure, such that only said at least one of the last few coils having the increased diameter habit is coiled about said reel structure in an expanded condition with respect to the remainder of said coils so as to assist said unwinding of wire from the reel.

2. An apparatus for winding a metal wire for assisting unwinding of wire from a reel comprising:

3. The apparatus of claim 2 wherein said means for selectively straining said wire comprises a selectively actuable roller disposed between said reel structure and said first roller means.

4. The apparatus of claim 2 which further comprises a second selectively actuable roller means having a roller axis which is perpendicular to said axis of said reel structure, said wire passing around said second selectively actuable roller means for adjusting the transverse pitch of said wire coils.

5. An apparatus for winding a metal wire for assisting unwinding of wire from a reel comprising:

a reel structure having an axis about which said wire may be wound;

roller means having a roller axis which is perpendicular to said axis of said reel structure, said wire passing around said roller means for adjusting the transverse pitch of said wire coils;

means associated with said roller means for selectively straining to a different degree said wire so that only at least one of the last few coils of said wire are given a larger pitch round habit so as to assist said unwinding of the reel; and means for rotati ng said reel structure to take up said wire, whereby only said at least one coil having said larger pitch round habit is coiled about said reel structure on an expanded condition with respect to the remainder of said coils.

* * * * *